United States Patent [19]

Bombis et al.

[11] Patent Number: 4,763,843

[45] Date of Patent: Aug. 16, 1988

[54] FUEL CUTOFF FOR A BURNER ATOMIZER

[75] Inventors: Dieter Bombis; Ernst Becker, both of Vilters; Paul Wildhaber, Balzers; Franz Vogler, Madris-Vermol; Peter Müller, Mühlehorn, all of Switzerland

[73] Assignee: Elco Oel-und GasbrennerwerkeAG, Switzerland

[21] Appl. No.: 940,482

[22] Filed: Dec. 9, 1986

[51] Int. Cl.[4] ..... B05B 1/30

[52] U.S. Cl. ..... 239/571; 239/533.7; 251/65

[58] Field of Search ..... 251/65; 137/528; 431/119; 239/570, 571, 533.7

[56] References Cited

U.S. PATENT DOCUMENTS

| | | | |
|---|---|---|---|
| 2,646,071 | 7/1953 | Wagner | 251/65 |
| 2,667,895 | 2/1954 | Pool et al. | 251/65 |
| 3,439,876 | 4/1969 | Shook | 239/533.7 |
| 3,495,620 | 2/1970 | Raimondi et al. | 251/65 |

*Primary Examiner*—Carroll B. Dority, Jr.

*Attorney, Agent, or Firm*—McGlew and Tuttle

[57] ABSTRACT

An oil burner for heating systems includes an atomizer nozzle placed in or connected to an oil feed pipe and a shutoff element is arranged in the oil feed pipe which has a blocking element which can be moved by the inflowing oil, within limits. The blocking element or a part adjacent the oil flow conduit are formed either entirely or partially from a permanent magnet and one can be moved into the closed position by its magnetic force to reliably prevent dripping of the oil from the atomizer nozzle after completion of a combustion process.

5 Claims, 3 Drawing Sheets

FUEL CUTOFF FOR A BURNER ATOMIZER

BACKGROUND AND FIELD OF THE INVENTION

The invention relates in general to burners and in particular to a new and useful oil burner for heating systems with an atomizer nozzle placed in an oil feed pipe.

In the oil burners used in heating systems, several drops of oil exit from the atomizer nozzle before and after each combustion process, unless special provisions are made. The burner tube and/or the heating area are contaminated with this dripping oil; also, ignition problems can be caused by it and the mixing devices can coke up, so that sometimes, operation of the heating system is disrupted.

In order to prevent dripping of the fuel and the disadvantages related with this, it is known that a release can be connected to the atomizer nozzle to release the pressure of the oil feed line, or to provide it with a vacuum valve. However, in spite of this significant construction effort, particularly when light oil is used as the fuel, and it is preheated and therefore has a low viscosity, dripping cannot be completely prevented. The contamination of a heating system which results from unburned oil dripping down therefore generally has to be accepted as unavoidable.

From DE-GM No. 82 69 069, it is furthermore known that a collector device made of a heat-resistant material, for example in the form of a plate which can be exchanged, can be provided in an oil burner below the atomizer nozzle. In this way, the oil dripping from the atomizer nozzle is collected and can therefore no longer get into the burner pipe or into the heating area, but dripping of the atomizer nozzle is not prevented.

SUMMARY OF THE INVENTION

It is therefore the task of the invention to design an oil burner in such a way that after completion of a combustion process, dripping of oil from the atomizer nozzle is reliable prevented. The construction effort required for this is supposed to be kept as small as possible, also, high reliability must be guaranteed.

According to the invention, this is achieved by arranging a shutoff element in the atomizer nozzle and/or the oil feed pipe, which has a blocking element which can be moved by the inflowing oil, within limits and which is formed entirely, or partially, from a permanent magnet and can be moved into the closed position by its magnetic force or by the magnetic force of a fixed permanent magnet.

It is practical in this connection to form the shutoff of a sleeve-shaped basic element made of unmagnetizable material, which can be connected with the atomizer nozzle, or the oil feed pipe, by means of a screw connection or something similar. The blocking element can be moved, within limits, in the basic element, and an anchor, which is fixed in the basic element and works together with the permanent magnet, through which the oil preferably flows centrally.

The blocking element should be placed, with lateral play, in the basic element, in such a way that it can be moved axially, so that the oil can flow past it, but for the same purpose it is also possible to provide one or several cuts for the inflowing oil on the inner mantel surface of the basic element and/or the outer mantel surface of the blocking element.

It is further appropriate to form the blocking element from a U-shaped bearer and a permanent magent arranged in it, which is recessed relative to the frontal surface of the bearer and which acts together with the fixed anchor, and to equip the anchor with a contact surface for the blocking element on the side which faces the blocking element.

The adjustment path of the blocking element can be limited is a simple manner either by tabs which are formed onto the basic element, by a collar worked onto it, or something similar.

In order to avoid contamination, there should also be a filter or a screen inserted in the basic element or the anchor in the flow direction, infront of the blocking element.

If an oil burner is equipped with a shutoff element structured according to the invention, this guarantees that after completion of a combustion process, the oil feed line is blocked off immediately, and no oil can drip from the atomizer nozzle. This is because the blocking element is immediately brought to the closed position because of the force of the permanent magent, as soon as the oil no longer flows through it. Subsequent dripping is therefore impossible, since the closing force is also strong. And since the blocking element does not have to be moved counter to the force of a spring, which increases as a function of the adjustment path, but instead, the force of the permanent magnet which must be overcome for opening decreases constantly, rapid opening is also guaranteed after a sufficient damming pressure has built up. By limiting the adjustment path of the blocking element, this further guarantees that the blocking element is automatically returned to the closed position by the magentic force of the permanent magnet.

Accordingly, it is an object of the invention to provide a fuel shutoff for a fuel line having an atomizer which includes a moveable blocking element which is confined for movement between a position in which it blocks off the flow of fuel to one in which it permits the flow of fuel and which includes a magnet associated with the element or the conduit which acts to draw the blocking element into a shutoff position permitting it to be moved against the magnetic force by the fuel when the flow through the conduit is resumed.

A further object of the invention is to provide a device for use with a burner or heating system which acts to prevent dripping of the atomizer knob by closing off the fuel flow with a blocking element which acts in addition to the termination of the fuel supply pressure.

A further object of the invention is to provide a device for preventing dripping of an atomizer which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
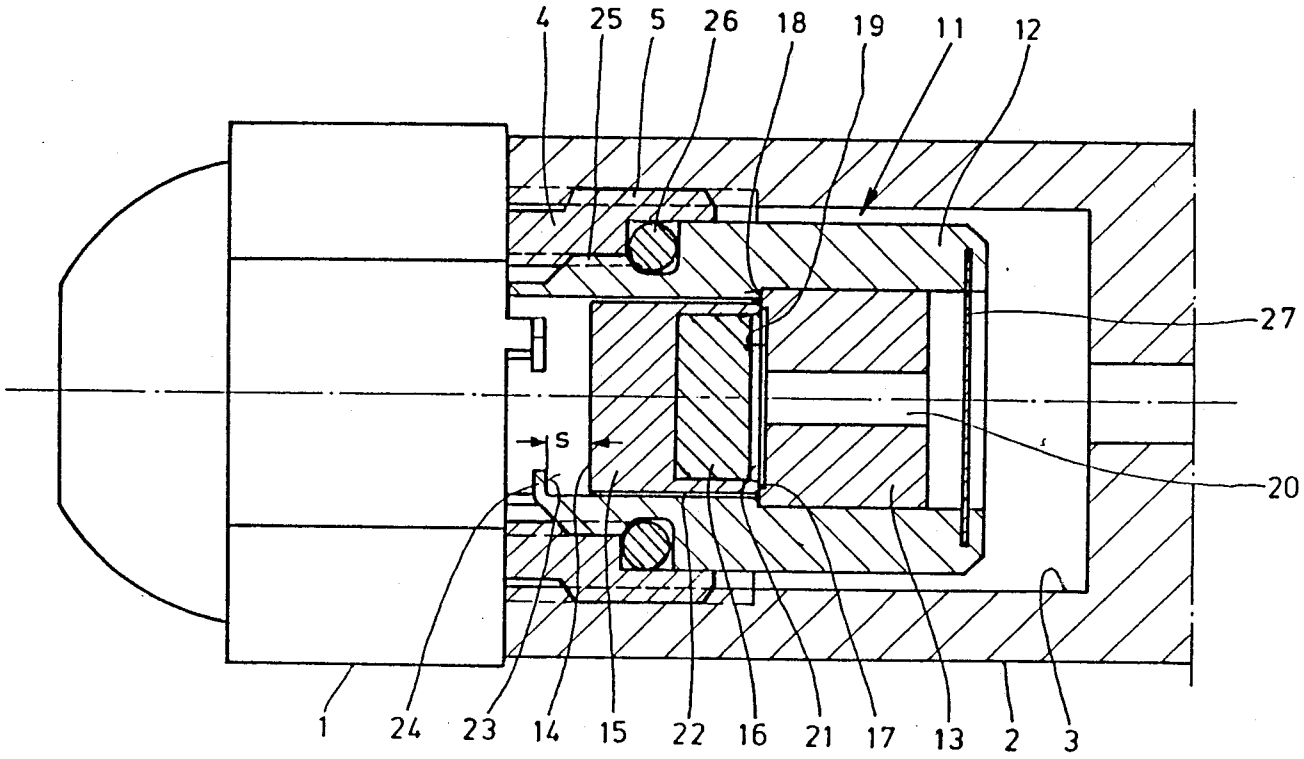
FIG. 1 is an axial sectional viewing a shutoff element inserted in an oil feed pipe in front of an atomizer nozzle, in an axial cross section.

Referring to the drawings in particular the invention embodied therein in FIG. 1 comprises a fuel drip control for a liquid fuel oil burner which includes a fuel supply line or oil feed pipe 2 terminating in an atomizer nozzle 1. In accordance with the invention a moveable blocking element 14 is positioned in the fuel supply line 2 and means are provided for confining movement of the blocking element 14 from a position against tabs 24 in which it opens and permits full fuel flow to a position in which it rests against an anchor member 13 of the fuel conduit and blocks further flow of fuel. The invention provides a permanent magnet 16 which in the embodiment of FIG. 1 is associated with a moveable blocking element 14 and is attracted by an anchor portion 13 which is stationarily positioned within the fuel conduit and when there is no fuel flowing through the conduit is attracted against the anchor 13 and blocks the flow of fuel so that there is no dripping out of the atomizer nozzle 1. The pressure of the fuel flow is sufficient to overcome the magnetic attraction of the permanent magnet 16 to the anchor 13 so that pull of fuel flow can be established by the action of the fuel to force the magnet 16 with the blocking element 14 to a non-blocking position.

Figure 3:
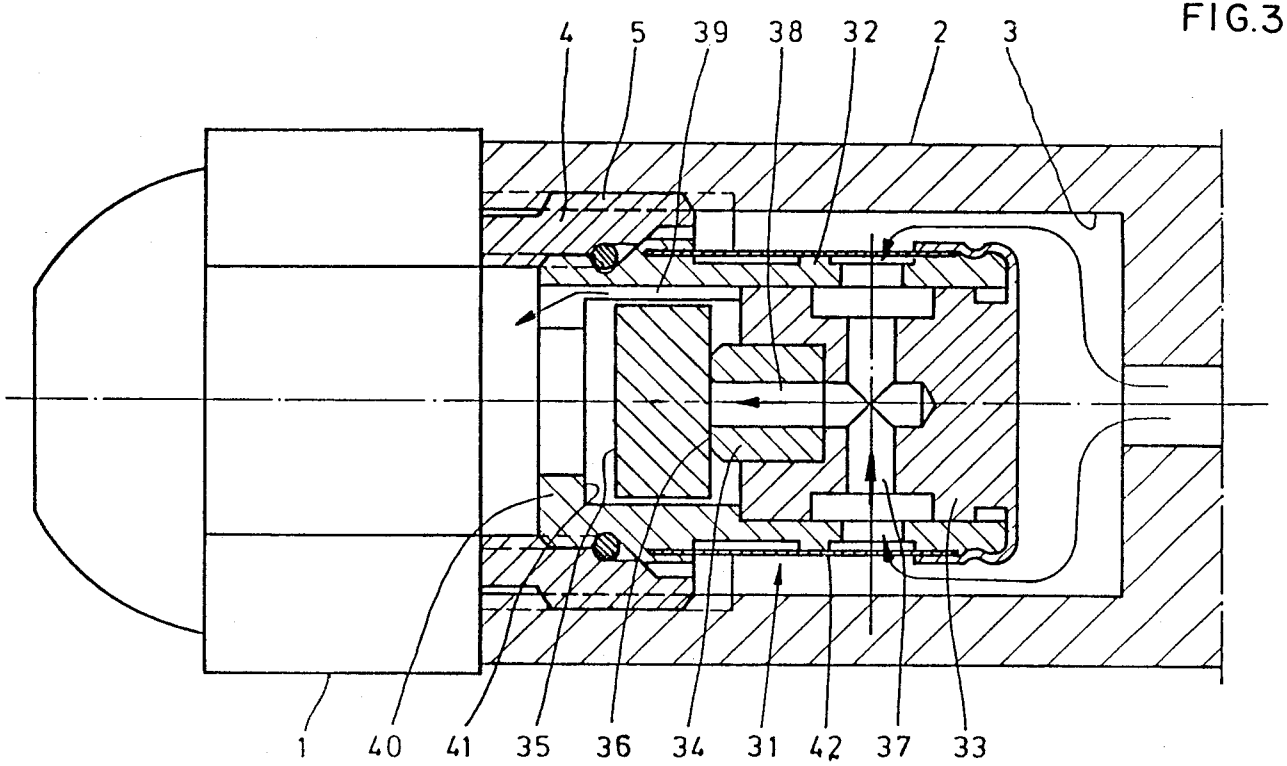
FIG. 3 is a different embodiment of a shutoff element of an axial cross-section.

The oil burner shown in FIGS. 1 and 3 comprises an atomizer nozzle 1 and an oil feed pipe 2, in which the atomizer nozzle 1 is held in place by means of an insert or connection 4 having a threaded connection 5.

In order to immediately interrupt the feed of fuel to the atomizer nozzle after completion of a combr:stion process, a shutoff element 11 is installed in a. recess 3 of the oil feed pipe 2. The shutoff element includes a body or a basic element 12 made of unmagnetizable material, an anchor 13 fixed in the basic element, as well as a blocking element 14 which can be moved axially, withih limits. The blocking element 14 is formed of a U-shaped bearer 15 and a permanent magent 16 which is inserted in it, which is recessed relative to the frontal surface 17 of the bearer 15, so that a damming area 21 is created for the oil flowing in through a central more 20 of the anchor 13. The frontal surface of the anchor 13 is also recessed by a recess 19 worked into it, the frontal surfaces 17 and 18 of the blocking element 14 and the anchor 13 therefore have contact, forming a good seal.

Figure 2:
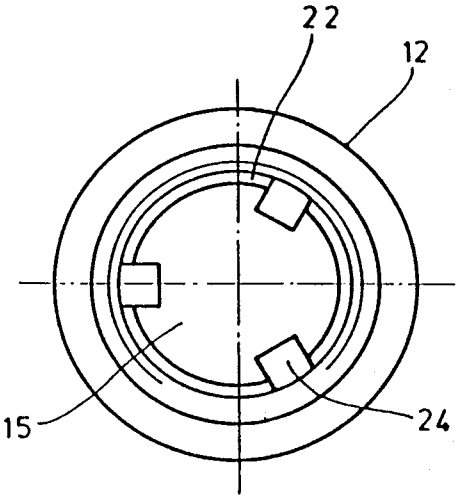
FIG. 2 is a frontal view of the shutoff element according to FIG. 1.

The blocking element 14 is set so that it can be moved axially in the sleeve-shaped basic element 12, with play. Because of the ring gap 22 formed as a result, oil can flow past the blocking element 14 as soon as it is no longer rests against the anchor 13, and reach the atomizer nozzle 1. In addition, there are three tabs 24 projecting towards the inside formed onto the basic element 12, which is screwed into the insert 4 by means of a thread 25, as can also be seen in FIG. 2, so that stop surfaces 23 are created to limit the adjustment path 5 of the blocking element 14.

When fuel is passed to the atomizer nozzle 1, for example by means of an oil feed pump, then the fuel flows through the shutoff element 11, since there is a gasket 26 arranged between the basic element 11 and the insert 4. The inflowing oil therefore impacts against the blocking element 14, and as soon as the force of the oil is greater than the holding force of the permanent magnet 16, it is moved to the left until it rests against the tabs 24. The inflowing oil therefore automatically opens the shutoff element 11. And if no more oil is being passed to the shutoff element, the force of the permanent magnet 16 immediately causes the blocking element 14 to go back to the closed position as shown, dripping of oil is therefore reliably excluded. A screen 27 inserted in the basic element 12 is used to catch any contaminations contained in the oil and operating problems are prevented with this.

A shutoff element 31 in FIG. 3 is structured in a similar way. In a sleeve-shaped basic element 32, there is a bearer 33 provided with bores 37 for the inflowing oil, in which an anchor 34 is placed. In addition, a blocking element 35 is placed in the basic element 32 so that it can be moved axially, this blocking element comprising a permanent magnet.

Because of the magnetic force of attraction by the metal bearer 33 the blocking element rests against the frontal surface 36 of the anchor 34 and seals it as long as no oil is being passed into the shutoff element 31. With the inflowing oil, however, the blocking element 35 is pressed against a stop 41, which is formed from a collar of the basic element 32, so that the oil can flow out of the bore 38 of the anchor 33 and to the atomizer nozzle through axially directed recesses 39 of the basic element 32. The oil flowing radially through the basic element 32 when this happens is also cleaned by means of a screen 42, before it enters the basic element.

The magnets, 16 in the embodiment of FIG. 1, and 35 in the embodiment of FIG. 3, comprises the moveable blocking element but the stationary parts 13 (FIG. 1) and 34 may be made of a permanent magnet portion and the moveable blocker may comprise a magnetically attractable part.

While specific embodiments of the invention have been shown and described in detail to illustrate the application of the principles of the invention, it will understood that the invention may be embodied otherwise without departing from such principles.

What is claimed is:

1. A fuel drip control for a liquid fuel oil burner, comprising a fuel supply conduit with an atomizer, a movable blocking element in the fuel supply conduit, means confining said blocking element from movement between a position in which it is disposed so as to block the flow of fuel through said conduit and through said atomizer to an open position in which it unblocks the flow, and a permanent magnet provided in at least a portion of one of: said conduit and said blocking element, acting to attract said blocking element to a position shutting off said conduit, the fuel flow moving the blocking element out of a blocking position overcoming the permanent magnet attracting force, a sleeve-shaped basic element connected into the fuel line adjacent said atomizer and means defining a connection between said basic element and the interior of said fuel supply conduit, said blocking element being arranged for movement within said sleeve-shaped basic element, an anchor in said basic element arranged in a fixed position therein and having a fuel flow passage therethrough, said blocking element having a permanent magnet portion which is attractable by said anchor to position the bocking element in a blocking position in which it blocks the fuel passage through said anchor, said blocking element comprising a U-shaped varying element having a face with a recess which contains a permanent magnet attractable to said anchor.

2. A fuel drip control for a liquid fuel oil burner, comprising a fuel supply conduit with an atomizer, a movable blocking element in the fuel supply conduit, means confining said blocking element from movement between a position in which it is disposed so as to block the flow of fuel through said conduit and through said atomizer to an open position in which it unblocks the flow, and a permanent magnet provided in at least a portion of one of: said conduit and said blocking element, acting to attract said blocking element to a position shutting off said conduit, the fuel flow moving the blocking element out of a blocking position overcoming the permanent magnet attracting force, a sleeve-shaped basic element disposed within said fuel supply conduit having an interior surface with an inner portion having a plurality of inwardly extending passages for the inflowing oil, said blocking element being arranged within said sleeve-shaped basic element and comprising a permanent magnet, said basic element defining said means confining said blocking element for movement.

3. A fuel drip control for a liquid fuel oil burner, comprising a fuel supply conduit with an atomizer, a movable blocking element in the fuel supply conduit, means confining said blocking element from movement between a position in which it is disposed so as to block the flow of fuel through said conduit and through said atomizer to an open position in which it unblocks the flow, and a permanent magnet provided in at least a portion of one of: said conduit and said blocking element, acting to attract said blocking element to a position shutting off said conduit, the fuel flow moving the blocking element out of a blocking position overcoming the permanent magnet attracting force, said blocking element comprising a U-shaped bearer member having a rear portion with a permanent magnet therein and including an anchor member within said fuel supply conduit having a fuel passage and an end face which is attractable to the permanent magnet.

4. A fuel drip control for liquid fuel according to claim 3 including a sleeve shaped basic element disposed within said fuel conduit and an insert threaded to said sleeve member and to the interior of said fuel conduit, said sleeve shaped basic element having inwardly projecting tabs said blocking element being positioned between said tabs and magnetically attractive end face of said fuel conduit, said tabs and said end face comprising said means confining said blocking element for movement.

5. A fuel drip control for liquid fuel according to claim 4 including an anchor member disposed within said sleeve-shaped member and forming the end of said conduit against which said blocking element is positionable in a flow cutoff position and including a screen contained at one end of said sleeve-shaped member, said anchor member having a central bore therethrough for the flow of fuel therethrough.

* * * * *